United States Patent [19]

Jung et al.

[11] Patent Number: 4,505,050

[45] Date of Patent: Mar. 19, 1985

[54] DRYING APPARATUS FOR METALLIC BELT PROCESSED IN A FLUID

[75] Inventors: Helmut Jung, Hagen; Franz G. Pempera, Neuwied; Udo Riedesel, Iserlohn, all of Fed. Rep. of Germany

[73] Assignee: Mannesmann Aktiengesellschaft, Dusseldorf, Fed. Rep. of Germany

[21] Appl. No.: 471,840

[22] Filed: Mar. 3, 1983

[30] Foreign Application Priority Data

Mar. 9, 1982 [DE] Fed. Rep. of Germany ..... 3208408

[51] Int. Cl.[3] ..... F26B 13/00

[52] U.S. Cl. ..... 34/54; 34/155; 34/160

[58] Field of Search ..... 34/48, 54, 155, 156, 34/158, 160

[56] References Cited

U.S. PATENT DOCUMENTS

| | | | |
|---|---|---|---|
| 1,236,359 | 8/1917 | Reynolds | 34/160 |
| 2,338,167 | 1/1944 | Dodge et al. | 34/158 |
| 3,089,252 | 5/1963 | Daane et al. | 34/160 |
| 3,417,484 | 12/1968 | McCarthy | 34/156 |
| 4,200,994 | 5/1980 | Mellor | 34/158 |
| 4,286,392 | 9/1981 | Viland | 34/155 |

FOREIGN PATENT DOCUMENTS

| | | | |
|---|---|---|---|
| 812429 | 4/1959 | United Kingdom | 34/160 |

*Primary Examiner*—Larry I. Schwartz
*Assistant Examiner*—David W. Westphal
*Attorney, Agent, or Firm*—Mandeville and Schweitzer

[57] ABSTRACT

In an apparatus capable of drying metallic belts or strands of varying widths, a hot air blowing system is arranged such that the effective width of the hot-air flow is selectively adjusted according to the width of each belt intended to be dried. The otherwise present but now excess hot air produced when narrower belt widths are dried is then directed to the suction or inlet side of the air blower to thereby recover otherwise lost heated air. This recycled heated air is redirected back to the air blower to thereby conserve energy at the heat exchanger which is used to heat the air. The quantity of hot air passing per unit time corresponding to a decreased belt width may also be adjusted by means of a valve of the blower system, thereby lowering the heating energy needed to be supplied to the heat exchanger.

8 Claims, 3 Drawing Figures

DRYING APPARATUS FOR METALLIC BELT PROCESSED IN A FLUID

BACKGROUND OF THE INVENTION AND DESCRIPTION OF THE PRIOR ART

The present invention is directed to a drying apparatus for a metallic belt or strand which has been processed by being passed through a fluid. More specifically, the drying apparatus is for a metallic strand coming from an acid treating plant. The drying apparatus basically comprises two opposed blower systems for directing hot air from above and below the strand. The hot air blowers extend fully across the belt width of the maximum belt or strand which might be dried by the apparatus and also extends some distance in the lengthwise direction of the strand. The hot air is directed to the belt by an air blower which first directs the air through a heat exchanger. The heat exchanger serves to heat the air which is then directed to the blower systems.

According to the prior art, drying apparatus of this type have been constructed by calculating the heat output needed for the maximum belt width and the maximum speed of movement of a belt. In this manner, for belts of less than maximum width, energy in the form of hot air is passed purposelessly into the environment. The spectrum of belt widths in a processing line for such metallic belts ranges between 600 and 1,550 mm. The surrounding air, drawn into an air blower by suction, is generally heated in the heat exchanger to a temperature of between about 373° to 423° K., i.e., 100°–150° C., prior to the air being directed to the blower systems for drying.

SUMMARY OF THE INVENTION

The aim of the present invention is to decrease the energy consumption of drying apparatus for metallic belts or strands. The present invention accomplishes this result by adjustably modifying the effective drying width of the hot air flow from the blower systems with respect to the then sought-to-be-dried belt width and by conducting the now excess hot air from the blower systems back to the suction side of the air blower. This creates the possibility of efficiently recycling the otherwise lost excess heat, in connection with the drying of less than maximum belt widths. The savings in energy manifests itself in the lowering of the amount of heat energy needed to be supplied to the primary circuit of the heat exchanger.

When the air blower rotates at a constant speed of rotation, the excess hot air is recycled to the inlet or suction side of the air blower where it is mixed with fresh air and then efficiently heated in the heat exchanger. A quantity regulating valve, having an adjustable air passage, is provided in the pipe line carrying the excess air to the inlet or suction side of the air blower. This regulating valve is closed when the drying process is acting on belts of maximum belt width since no excess hot air is then available for recycling. When smaller belt widths are sought to be dried, and correspondingly, a smaller effective width of the hot air flow is all that is needed for the drying, the air passage of the quantity regulating valve is enlarged such that the now present excess hot air, resulting from the decrease of the necessary but fully effective width of the hot air flow, may be returned and recycled into the air circuit. The pressure must, of course, be maintained in the blower systems, under which pressure the hot air necessary for drying the belt is blown out per unit time. With the otherwise excess hot air recycled back to the air blower, the energy needed to be supplied to the heat exchanger to bring the air to a predetermined temperature is correspondingly decreased. This results in a significant energy savings.

The present invention provides yet another solution of the energy savings problem. According to this second solution, the effective width of the hot air flow from the blower systems is, selectively adjusted according to each belt width, but, however, in connection with a constant rotating, speed regulating, volumetric type air blower, for example, a Roots blower having a certain cubic feet/minute of air running capacity, the quantity of air per unit time is adjusted to the belt width. According to this embodiment of the invention, the production of excess quantity of hot air is eliminated at the beginning and the energy savings rest, in part, in the decreased required performance of the blower and, in part, on the decreased required heating performance of the heat exchanger.

The effective width of the hot air flow to the metallic strands can be adjusted by selectively disconnecting and reconnecting air valves of the blower systems according to the belt width sought to be dried. However, it is recognized by the present invention that the lateral ends of the air slits through which the air exits the blower systems and extending across the maximum belt width may be infinitely adjusted, i.e., gradually covered and uncovered. To accomplish this goal, the ends of the air exiting slits may be variably covered by sawtoothed-shape covering metal sheets which are adjustable in a direction extending traversely to the slits. The air exiting slits are preferably shaped in the form of a chevron, i.e., downward slanted as a house roof so that the hot air fins, also chevron or roof-shaped and protruding away from said slits, direct, by the air blowing, the moisture of the belt toward the edges of the belt in a snowplow type manner.

The drying effect of the metallic strands by the air blowing apparatus may also be improved, with accompanying energy savings, by having the blower systems, extending across the full length of the maximum belt width and along some length, provided with air exit openings which are designed upwardly for the lower dryers and downwardly for the upper located dryers. In this manner, the hot air flow, hitting the belt, is directed transversely to the belt surface. This gives the added drying advantage that the belt edges are forcefully swept by hot air, the drying of said edges having previously not been fully accomplished.

Two exemplary embodiments of the present invention are illustrated in the drawings:

DETAILED DESCRIPTION OF THE INVENTION

Figure 1:
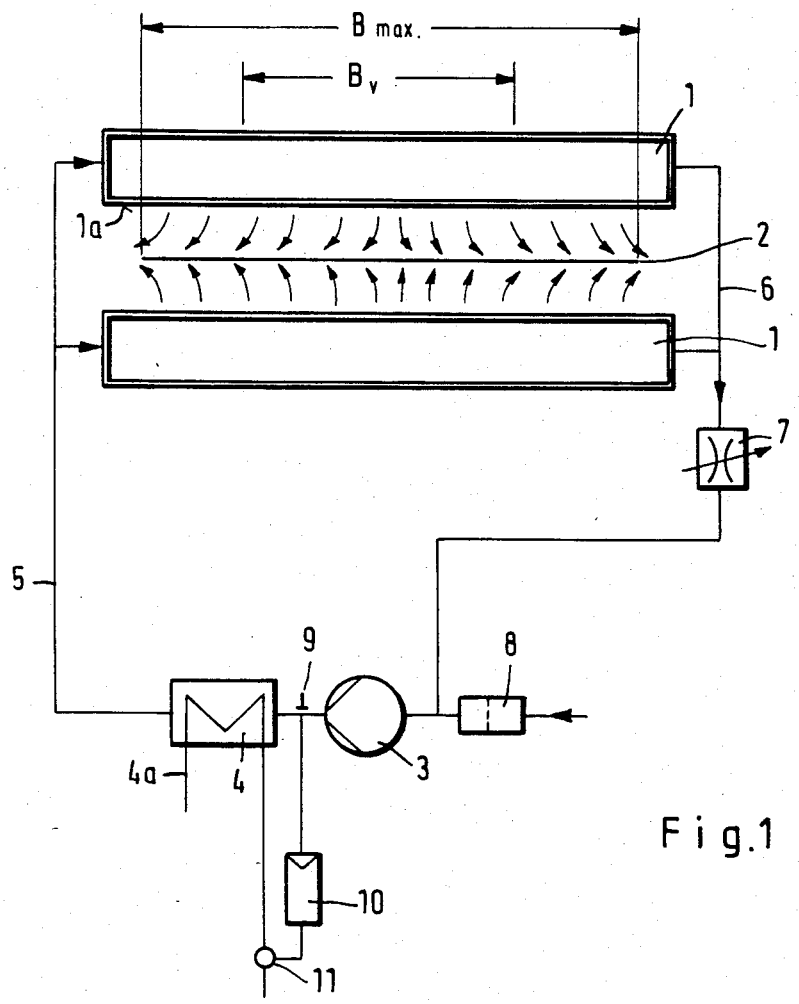
FIG. 1 is a cross sectional schematic illustration of a hot air, belt drying apparatus having hot air directed in a closed air circuit.

With reference to FIG. 1, the drying apparatus comprises two air or gas blower systems 1 in the general shape of closed rectangular casings, which are arranged above and/or, if desired, below the belt or strand 2 intended to be dried. Ambient or fresh air is sucked into the inlet side of an air blower 3, at a constant rate, and then is heated up by passing through a heat exchanger 4. The heat exchanger 4 has a primary heat providing circuit 4a. The pipe line 5 carries the now-heated air to the inside of the blower system 1. The air blower systems 1 extend horizontally across slightly more than the maximum belt width ($B_{max}$) of the largest belt intended to be dried by the system. The blower systems 1 extend along a certain drying length of the belt to provide a two dimensional area of drying. If the effective width of the hot air flow from the blower systems 1, illustrated by the converging arrows (emanating from the blower systems 1), is desirably decreased to provide adequate drying to a new smaller belt width $B_v$, as will be more fully explained, a quantity of the now excess hot air (i.e., $B_{max}-B_v$) results in the casing-type blower systems 1. This excess air is conducted by the pipe line 6, is further passed through a quantity regulating valve 7 and back to the suction or inlet side of the air blower 3. The now recycled excess heated air mixes with the air sucked into the blower, obtained from the surrounding or ambient air which was first passed through a filter mechanism 8. On the outlet or high pressure side of the blower 3 is a heat sensor 9 which measures the temperature of the air as it enters the heat exchanger 4, which air contains a portion of already heated yet previously excess hot air. In relation to the measured entering temperature of the air into the heat exchanger, as measured by heat sensor 9, the energy, i.e., heat supplied to the primary circuit 4a of the heat exchanger 4 is correspondingly increased or decreased by a regulator mechanism 10, which acts to vary and control the adjusting member or valve 11. Thus, the quantity of heat supplied to the heat exchanger is controllably varied, depending upon the quantity of heated but excess air recovered. The air passageway of the quantity-regulating valve 7 is closed when a belt is being dried of the maximum belt width or, alternatively, is only slightly opened since, at this belt width, the heating output of the blower 1 is fully needed and no excess hot air is available. When the desired effective drying width of the hot air flow is decreased for drying of narrower belts, the excess of hot air ($B_{max}-B_v$) which results is recycled through an opening in the air passageway, through the quantity-regulating valve 7, and back into the air flow circuit.

Figure 2:
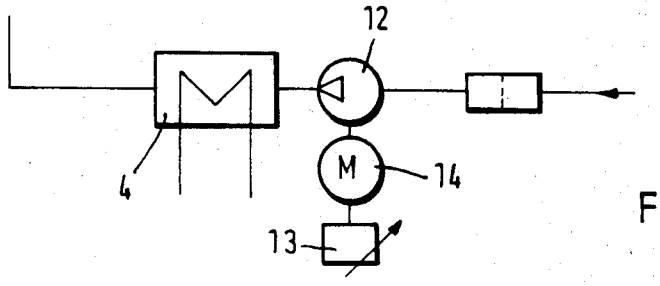
FIG. 2 is a partial schematic illustration of a different embodiment of the invention than that shown in FIG. 1, this second embodiment not being provided with recycling of the excess hot air.

In the exemplary embodiment shown in FIG. 2, there are, as compared to the embodiment of FIG. 1, two modifications of the basic invention. Line 6 having the quantity-regulating valve 7 as well as the heat sensor 9 and regulating and adjusting members 10 and 11, are eliminated. Blower 3 is replaced by a blower 12 which is a rotational regulating constant volume blower, for example, a Roots blower. The rotational speed of the motor 14 for driving the blower 12 may be adjusted by way of an adjusting device 13 in relation to the quantity of hot air passing per unit time, which corresponds to the desired effective width of drying. Due to the decreased use of the heating performance of the heat exchanger 4, there is an effective energy savings for decreased effective width of drying.

Figure 3:
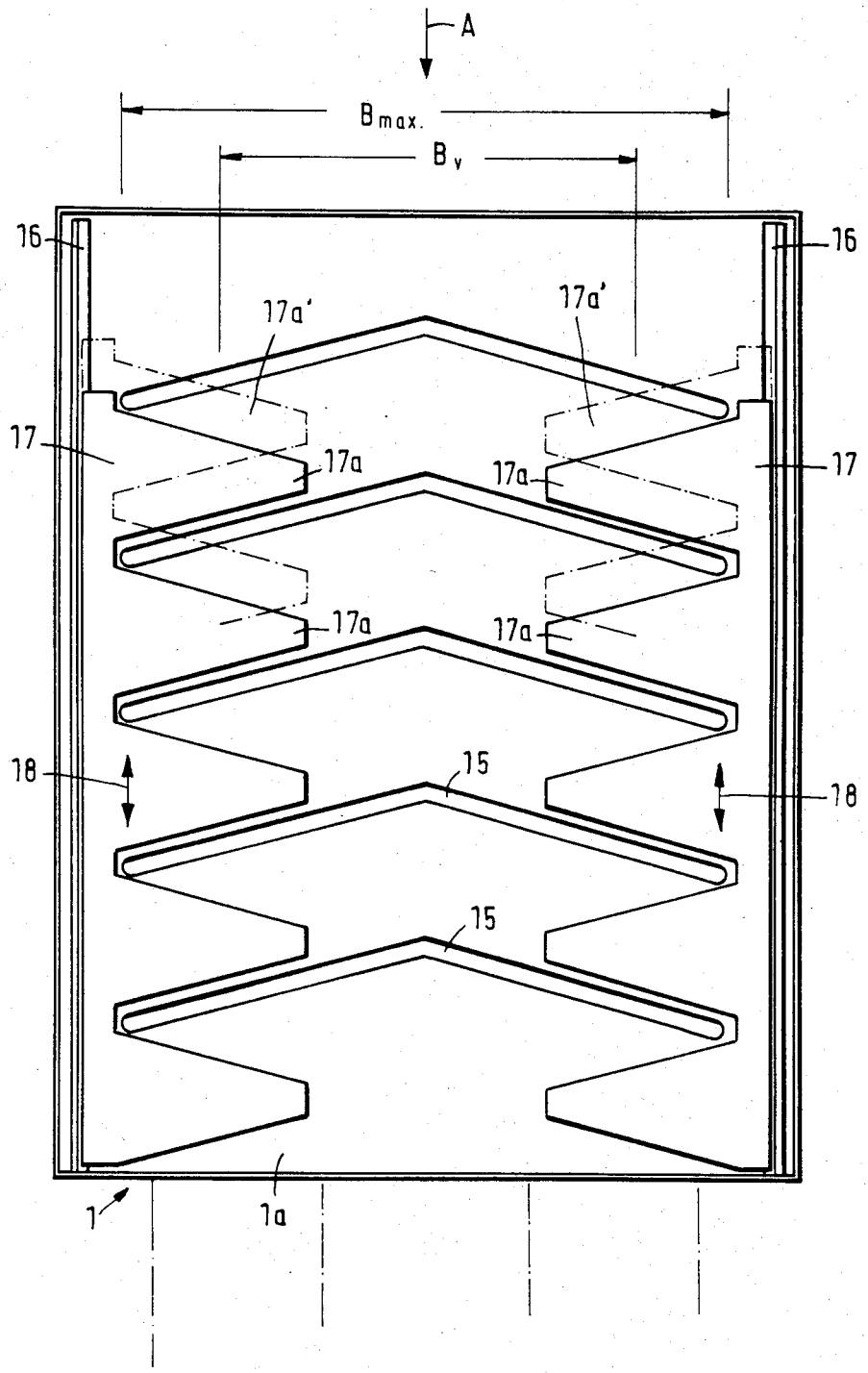
FIG. 3 is a view of an air blower system provided with air exit slits.

FIG. 3 shows a top plan view of the slit side of a closed case-type blower system 1. A plurality of chevron or roof-shaped air exit slits 15 are built into the casing wall unit 1a which is facing the belt 2, said slits also having roof-shaped hot air fins outwardly protruding. The passage direction of the belt from upstream to downstream is shown in the drawing direction as arrow A. The roof shape of the air exit slits 15 causes the moisture carried by the belt 2 to be progressively diverted outwardly towards the edges of the belt. Since by virtue of the blower systems being of a closed design, the hot air flow is exclusively diverted transversely to the direction of the passing belt, as shown in FIG. 1, the belt edges are especially intensively swept by the hot air flow.

Each casing wall unit 1a of the blower system 1, facing the belt 2 supports a pair of guiding bars 16 which extend along the blower systems in the passing direction A of the belt and serve to slidably guide and maintain the desired position of adjustable covering elements 17. These covering elements 17 have a saw-toothed configuration, i.e., are provided with trapezoid-shaped covering areas 17a which extend across and oppose each other in pairs. The covering areas 17a, as shown in FIG. 3, can be positioned between the adjacent air exit slits 15, i.e., in a non-air-blocking position, if the full width of the slits 15 corresponding to the maximum belt width $B_{max}$ are to be used for drying the belt 2 with hot air. By means of the relative adjustability of the covering elements 17, indicated by arrows 18, it is possible for the ends of the air exit slits 15 to be infinitely adjustably covered for the drying of narrower belt widths $B_v$. The drying of narrower belt widths is shown by the dot-dash line of FIG. 3 for the adjustment 17a'of the covering areas 17a. While not further illustrated, the covering elements 17 can, of course, be fixed in their respective covering positions by suitable detents or other temporary holding mechanisms.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

We claim:

1. A hot air blowing and drying apparatus for a metallic belt having been processed by passing through a fluid comprising:

(a) a pair of blower systems opposed to one another and arranged above and below the belt to be dried;

(b) said blower systems having a full hot air drying width extending at least as wide as the width of the greatest belt to be dried by the apparatus;

(c) said blower systems are provided with a plurality of air exiting slits extending across the full hot air drying width and positioned to face the belt;

(d) a constant pressure blower means for directing a substantially constant quantity of air flow to said blower systems capable of treating said full hot air drying width;

(e) a heat exchanger located between said air blower means and said blower systems for heating said air to a predetermined temperature prior to its introduction into said blower systems;

(f) means to selectively adjust the effective hot air drying width of said slits according to the actual width of the belt to be dried, the difference between the quantity of air necessary to treat said full hot air drying width of said slits and the quantity of air necessary to treat said effective hot air drying width defining a quantity of excess hot air for the actual width of the belt to be dried; and (g) closed system means for directing and recycling said quantity of excess hot air from said blower systems back to said air blower resulting in a decrease in the energy consumption required for said heat exchanger.

2. A drying apparatus as claimed in claim 1, wherein:

(a) said air blower is a constant speed of rotation type air blower; and (b) an air flow regulator valve is located between said blower systems and said air blower.

3. A drying apparatus as claimed in claim 1, wherein:

(a) said blower systems are provided with a plurality of air exiting slits extending across said full hot air drying width of said blower systems and spaced from one another in the longitudinal direction of passage of said metallic belt through said blower systems; and (b) said effective drying width of said blower systems is selectively infinitely adjusted by gradual covering of the lateral ends of said air exiting slits.

4. A drying apparatus as claimed in claim 3, wherein:

(a) said air exiting slits are gradually covered by saw-toothed shape covering elements which are transversely adjustable with respect to the extension of said air exiting slits.

5. A drying apparatus as claimed in claim 4, wherein:

(a) said covering elements are smaller in width than the distance between adjacent air exiting slits.

6. A drying apparatus as claimed in claim 3, wherein:

(a) said air exiting slits are chevron shaped.

7. A drying apparatus as claimed in claim 1, wherein:

(a) said hot air flow emanating from said blower systems is exclusively transverse to the direction of movement of the strand through said drying apparatus.

8. A drying apparatus for a metallic belt having been processed by passing through a fluid comprising:

(a) a pair of blower systems opposed to one another and arranged above and below the belt to be dried;

(b) said blower systems having a full hot air drying width extending at least as wide as the width of the greatest belt to be dried by the apparatus;

(c) said blower systems are provided with a plurality of air exiting slits extending across the full hot air drying width and positioned to face the belt;

(d) an air blower for directing a flow of air to said blower systems capable of treating said full hot air drying width;

(e) a heat exchanger located between said air blower and said blower systems for heating said air to a predetermined temperature prior to its introduction into said blower systems;

(f) means to selectively adjust the effective hot air drying width according to the actual width of said belt to be dried; and (g) said air blower being of the constant volume type and being selectively adjustable in accordance with the means to adjust the effective hot air drying width and the width of the belt to be dried.

* * * * *